United States Patent [19]

Bieri et al.

[11] 4,424,912

[45] Jan. 10, 1984

[54] CONTAINER WITH EXTENDABLE LEGS

[76] Inventors: Rudolf Bieri, Lindenstrasse 23, CH-8400 Winterthur; Jakob Klaeui, Burgstrasse 6, CH-8408 Winterthur, both of Switzerland

[21] Appl. No.: 235,142

[22] Filed: Feb. 17, 1981

Related U.S. Application Data

[63] Continuation of Ser. No. 23,196, filed as PCT CH78/00008, Aug. 17, 1978, published as WO79/00048, Feb. 8, 1979, § 102(e) date Mar. 15, 1979, abandoned.

[30] Foreign Application Priority Data

Jul. 19, 1977 [CH] Switzerland ..... 8932/77

[51] Int. Cl.[3] ..... B65D 25/00; A47B 3/08

[52] U.S. Cl. ..... 217/122; 108/130; 108/132; 108/133; 248/188.6; 248/439

[58] Field of Search ..... 217/122; 220/69; 108/130, 133, 131, 132; 248/188.1, 188.6, 188.7, 169, 171, 439; 308/46, 22, 47 R, 28, 34, 237 A, 58, 59; 16/348, 350, 277, 333, 343

[56] References Cited

U.S. PATENT DOCUMENTS

| | | | |
|---|---|---|---|
| 1,173,746 | 2/1916 | Sargent | 217/122 |
| 1,583,999 | 5/1926 | Scheibe et al. | 108/132 |
| 1,917,903 | 7/1933 | Sargent | 217/122 |
| 2,020,553 | 11/1935 | Hughes | 16/169 X |
| 2,459,529 | 1/1949 | Jogwick et al. | 108/132 |
| 2,478,678 | 8/1949 | Asnew et al. | 248/439 |
| 2,481,117 | 9/1949 | Jogwick et al. | 108/132 X |
| 2,514,061 | 7/1950 | Hood | 108/130 |
| 3,000,049 | 9/1961 | Terry, Jr. | 16/139 |
| 3,005,227 | 10/1961 | Harvey | 16/169 |
| 4,022,414 | 5/1977 | Egger | 108/132 X |
| 4,102,013 | 7/1978 | Newlon | 16/169 X |

FOREIGN PATENT DOCUMENTS

| | | | |
|---|---|---|---|
| 216701 | 1/1961 | Austria | 108/131 |
| 2261316 | 6/1974 | Fed. Rep. of Germany | 217/122 |
| 20825 | of 1880 | United Kingdom | 16/143 |
| 343303 | 2/1931 | United Kingdom | 16/143 |

*Primary Examiner*—Allan N. Shoap
*Attorney, Agent, or Firm*—Michael J. Striker

[57] ABSTRACT

A collapsable basket is disclosed, in which legs can be erected to a position in which the basket is supported above a floor, and in which the legs can be collapsed to allow the basket to rest on a floor without being supported by the legs. This erection and collapse of the legs is accomplished by handles located adjacent to the regions where the basket is grasped by a user, so that it is not necessary to let go of the basket to operate the legs. The invention is provided with various devices which prevent the legs from collapsing, once erected, unless such collapse is desired. Additionally, a special bearing is disclosed which is designed for use in this invention.

3 Claims, 9 Drawing Figures

Fig. 1
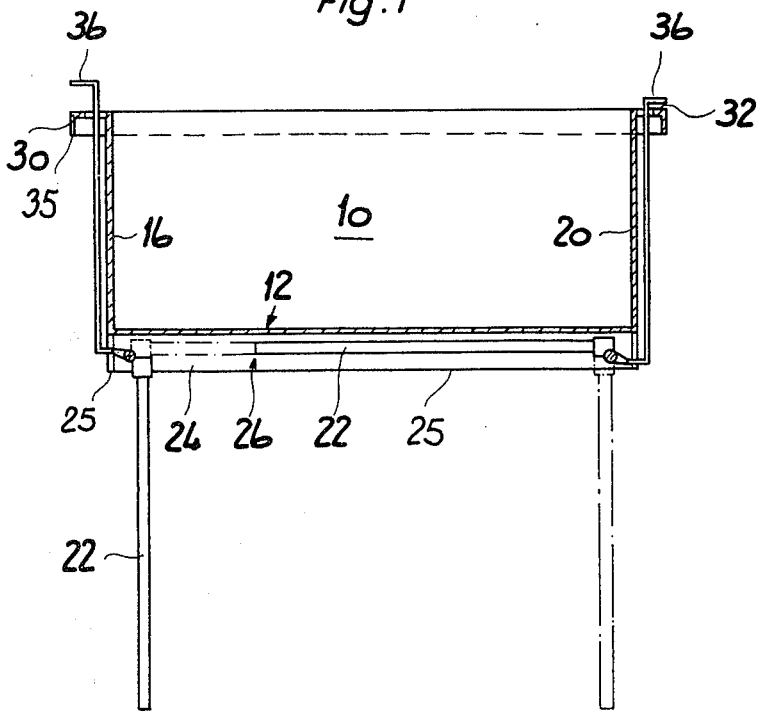
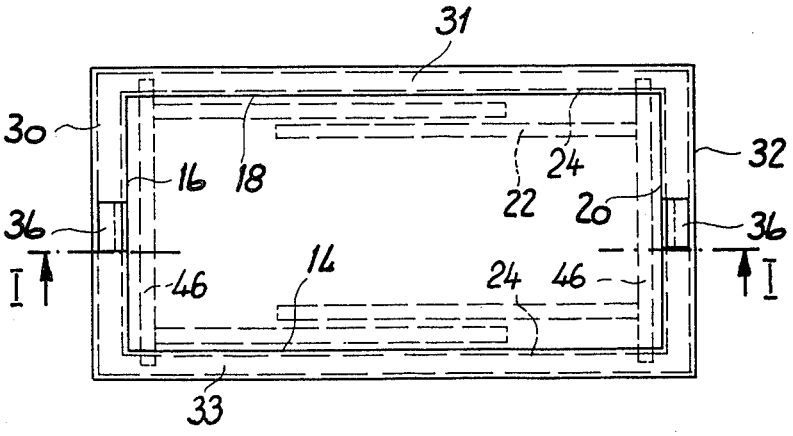
Fig. 2

CONTAINER WITH EXTENDABLE LEGS

This application is a continuation of Ser. No. 23,196, filed as PCT CH78/00008, on 7/17/78, published as WO 79/00048, on 2/8/79, § 102(*e*) date 3/15/79, now abandoned.

BACKGROUND OF THE INVENTION

1. FIELD OF THE INVENTION

This invention pertains to baskets which have legs that can be extended and withdrawn to enable the basket to be supported either above or on a floor. More particularly, this invention is directed towards laundry baskets of this general type which can be easily raised and lowered.

2. DESCRIPTION OF PRIOR ART

Baskets of this type are generally known. However, such known baskets have disadvantages relating to their ease of operation. For example, in Swiss Pat. No. 583 118 a laundry basket with extendable legs is disclosed. However, in this device, the legs are spring-loaded to bias the legs towards their extended position, in order to more easily extend them and thus raise the basket. However, in this device, it is inconvenient to retract the legs because the user must reach underneath the basket and press the legs inwardly against the pressure of the springs. In the event that the basket is full, the operation can be very difficult and the basket can tip over and spill its contents. Hence, this kind of basket has undesirable disadvantages.

SUMMARY OF THE INVENTION

It is the object of this invention to provide a collapsable basket, such as a laundry basket and the like, which is operable by a user in such a fashion that it is not necessary to reach underneath the basket with one arm to extend and retract the legs, holding the basket with the other arm. Moreover, it is the object of this invention to provide a collapsable basket which does not require the exertion of force against a spring, to further increase each of operation.

The objects, along with others which will become apparent, are achieved in this invention by the use of specially designed operating handles which are located adjacent the grips by which the basket is conventionally grasped by a user. In this invention, these handles can be operated by a user without releasing the grips. Thus, the danger of spilling the contents of the basket out during the extention and retraction of the legs is markedly reduced. Moreover, in this invention, any springs used are so designed that they do not pose any substantial resistance to retraction of the legs, which reduces the force required to move them. Hence, an easily operable collapsable basket is disclosed.

Moreover, a new bearing for use in such baskets is disclosed which is particularly advantageous for use therein. This bearing, which is of a very simple construction, not only provides for easy retraction and extention of the legs, but further provides for locking the legs in their extended position, so that the legs do not retract when the basket is loaded, and thus do not allow an overloaded basket to collapse.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 shows a vertical section of a first embodiment of the invention, in a schematic form;

FIG. 2 shows a top view of the invention, with line I—I showing the vertical plane which is seen in FIG. 1;

DETAILED DESCRIPTION OF PREFERRED EMBODIMENTS

Figure 3:
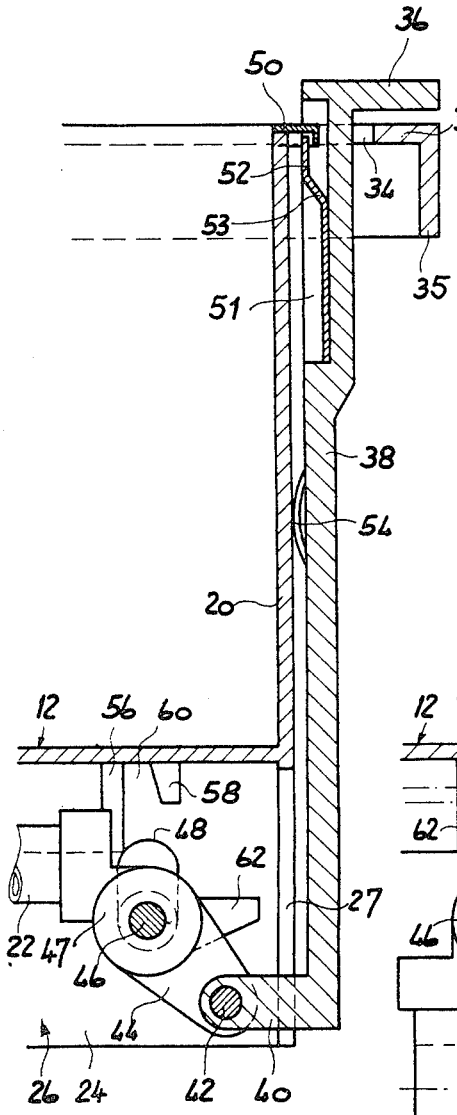
FIGS. 3 and 4 show the mechanism of the first embodiment of the invention, in, respectively, its collapsed and erected states.

A container, generally indicated by the numeral 10, takes the shape of a rectangular, open-topped box with rectangular, horizontal base 12, and rectangular, vertical walls, namely a front wall 14, a left wall 16, a rear wall 18, and a right wall 20. A peripheral skirt 24 extends underneath the base, and is formed by extensions of the walls which extend below the base 12. The skirt 24 thus forms a open-bottomed leg-storage region, generally denoted by numeral 26. It can be seen generally from FIG. 1 that the legs 22 which support the container 10 may be extended to the position shown in FIG. 1, enabling the container 10 to be supported above a floor (not shown). In the event that the legs 22 are to be retracted, they will assume the position shown as dashed lines in FIG. 1, and will be retracted into the leg-storage region 26 to enable the container 10, when placed on a floor, to rest upon the bottom edges 25 of the skirt.

A horizontal peripheral surface, composed of left portion 30, rear portion 31, right portion 32, and front portion 33, as is seen in FIG. 2, extends horizontally outwardly from the tops of the walls to form a top surface. A lip 35 extends downwardly from the outermost edges of portions 30, 31, 32, 33. It can thus be seen that a user may lift and lower the container 10, along with the legs 22, by grasping portion 30 with the left hand and portion 32 with the right hand, with the fingers encircling the lip 35. As can best be seen in FIGS. 3 and 4, portion 32 contains a central rectangular gap 34 through which one end of an elongated strut 38 extends. Before a detailed description of the workings of the mechanism of the invention is recited, it is appropriate to note here that the handle 36, on the top of strut 38, can be reached by the user's hand while grasping portion 32, which allows the legs to be erected and collapsed while holding the grip. Although portion 30, on the other side of container 10, is not shown in FIGS. 3 and 4, its mechanism is a mirror image of the mechanism shown in FIG. 3 and FIG. 4.

Figure 4:
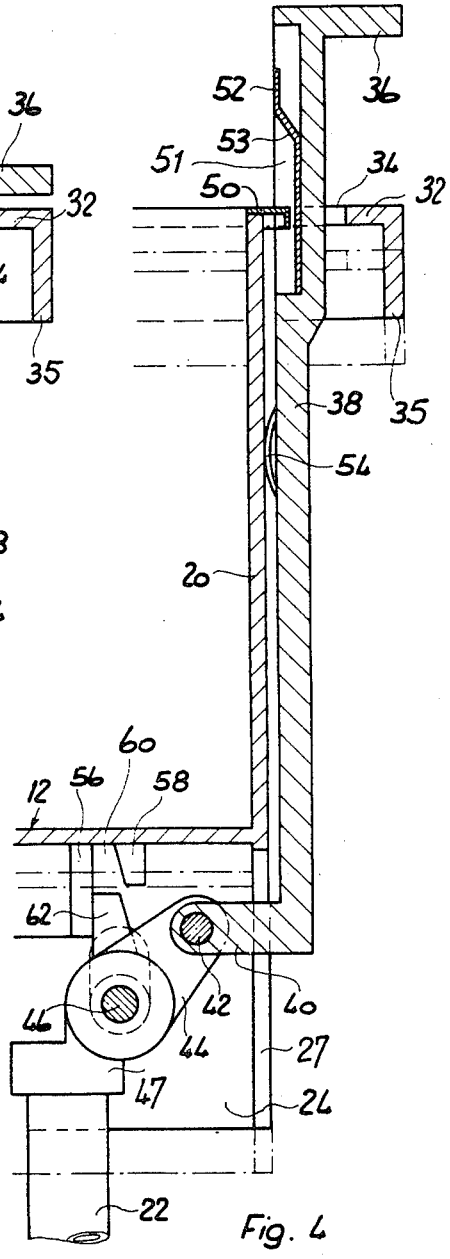

The four legs 22, as can be seen in FIGS. 1 and 2, are divided into two pairs, those pairs being the two legs 22 which are located adjacent the right wall 20 and those legs 22 which are located adjacent the left wall 16. Each pair of legs 22 is secured at the top ends of the legs to a bar 46 by a coupling 47. Bar 46 is located in an opposed and aligned pair of slots 48 located in opposed region of the skirt 24. Hence, the legs can be rotated to a collapsed position, such as is seen in FIG. 3, by rotating bar 46 in a clockwise sense as seen in that figure, and can be rotated to an erected state, as can be seen in FIG. 4 by rotation of the bar 46 in a counter-clockwise fashion as viewed in that figure. Moreover, each pair of legs 22 can move upwardly and downwardly as a unit towards and away from base 12, since on each side of container 10 the bar 46 can move upwardly and downwardly in slot 48. It should be noted that the bar and slot are shaped in such a fashion that the axis of the bar 46 always remains parallel to its corresponding wall, i.e. wall 20 as is seen in FIGS. 3 and 4 for the right-hand portion of container 20.

In order to accomplish this rotation, a link 44 is secured to the center of the bar 46, underneath the base 12 and within the edge confines of the leg-storage region 26. That end of the link 44 which is remote from bar 46 is pivotably secured to horizontal lower end 40 of elongated strut 38. Lower end 40, in order to reach the interior of the leg-storage region 26, passes through a slot 27 in skirt 24. It can be seen in FIGS. 3 and 4 that upper motion of strut 38 and downward motion of strut 38 will, respectively, cause counter-clockwise and clockwise rotation of bar 46, and thereby cause, respectively, erection. and collapse of the legs 22.

It is desirable, since motion of the strut 38 controls the position of the legs 22, to provide a locking means to enable the position of the strut 38 to be fixed between its positions, which correspond to erected and collapsed states of legs 22. This is accomplished by designing the top end of strut 38 with a recess 51 which contains a leaf spring 53. Leaf spring 53 is secured to strut 38 at its lower end, and its upper end 52 is free to move with respect to strut 38. When handle 36 of the strut 38 is pressed downwardly, the top end 52 of the spring, which forms a hook, is moved to the right as viewed in FIGS. 3 and 4 as it passes past flange 50, which define one of the edges of gap 34. After having passed flange 50, the top end 52 of the spring moves to the left as viewed in FIGS. 3 and 4, and can engage the bottom of the flange 50 as is seen in FIG. 3. Thus, upward movement of the handle 36 and strut 38 is prevented, and the legs 22 are held in their collapsed state within leg-storage region 26. However, when top end 52 is brought out of engagement with flange 50, the strut 38 may move upwardly in order to allow the legs to assume their erected positions by dropping down under the influence of their weight.

It can be seen in FIGS. 3 and 4 that biasing spring 54, which is attached to strut 38 and abuts right wall 20, urges the strut 38 to the right as is viewed in FIGS. 3 and 4, so that to collapse the legs 22 from their erected state it is only necessary to push the handle 36 downwardly, since biasing spring 54 will push the entire strut 38 to the right as viewed in these figures and will enable the top end 52 of leaf spring to bypass the flange 50.

Although the erection and collapse of the legs 22 has thus been described, it is necessary to further note that it is desirable to provide some sort of safety device which prevents the legs from collapsing under loading of the container 10. In order to accomplish this objective, long and short abutments 56 and 58 and detent cam 62 come into play. Detent cam 62 is fixed to the bar 46, and may be integral with coupling 47. Abutments 56 and 58 are secured to the base 12, and are spaced apart from each other by a recess 60. As can be seen in FIGS. 3 and 4, the detent cam, at its end which is distant from bar 46, assumes a trapezoidal shape which matches the shape of the recess 60 defined between long abutment 56 and short abutment 58. When the legs 22, as can be seen in FIG. 3, are in a collapsed position, detent cam 62 is adjacent to right wall 20 and does not play any part in the operation of the device. However, when the legs are erected, detent cam 62 is rotated to a position in which it abuts long abutment 56, thereby providing a stop which prevents over-rotation of bar 46 from ocurring. At this point, when a user allows the container 10 to rest on legs 22 on a floor, the legs 22, bars 46, and detent cams 62 are all forced upwardly with respect to the base 12, enabling detent cam 62 to be firmly lodged between the abutments 65 and 58 and thereby preventing accidental rotation of bars 46 resulting from over-loading of the container 10. In this manner, a safety means is provided.

Figure 5:
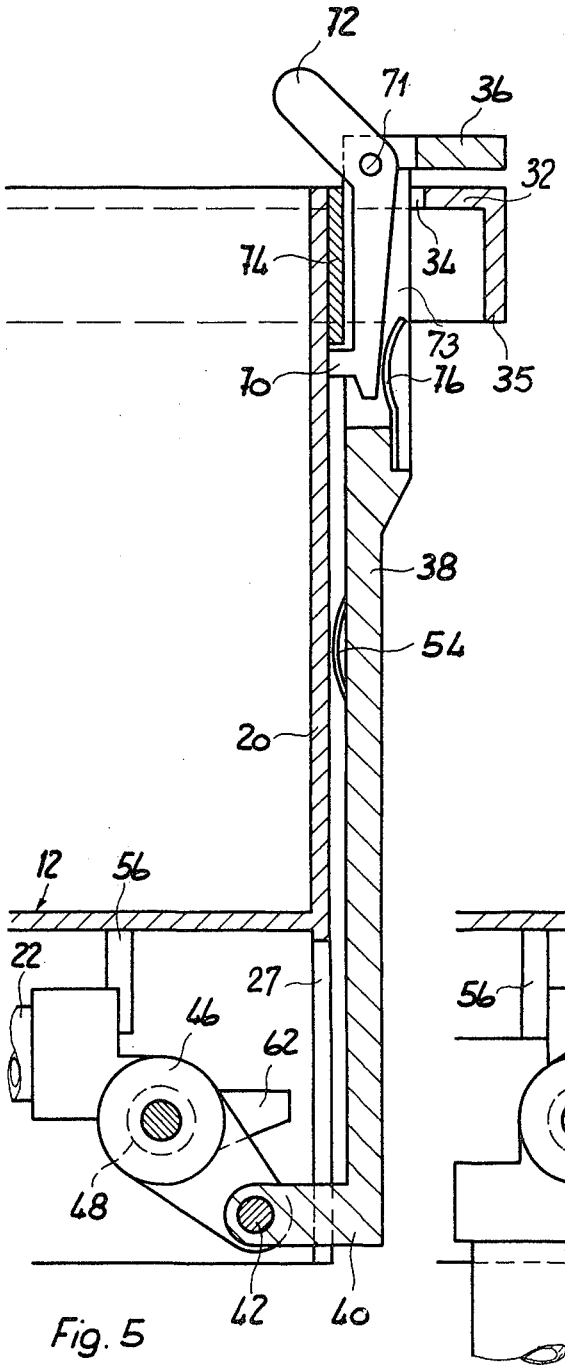
FIGS. 5 and 6 show a second embodiment of the invention, in, respectively, its collapsed and erected states.
Figure 6:
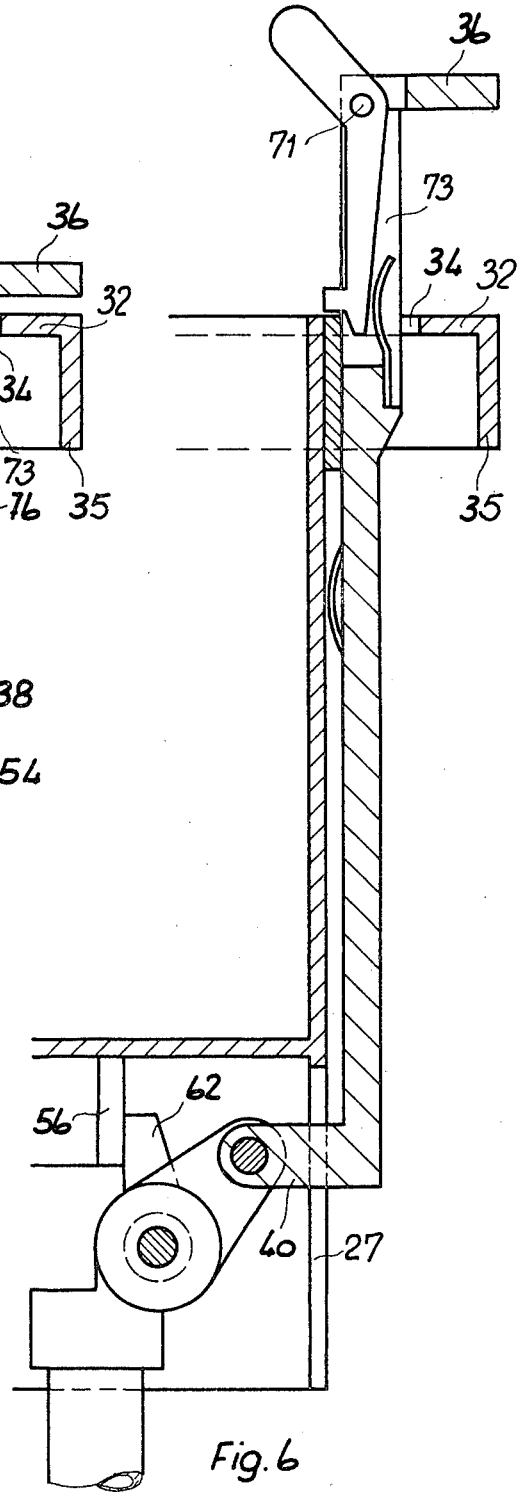

FIGS. 5 and 6 show an alternative construction of the top end of elongated strut 38, in a second embodiment of the invention. The mechanism enclosed within the legs-storage region 26 is identical to the mechanism described above, and thus will not be described further. The difference between the first and second embodiments resides in the substitution of a different mechanism for the leaf spring 53 and the flange 50 that were described in the above description. In the second embodiment shown in FIGS. 5 and 6, an arm which bears a pawl 70 and a pawl lever 72 is hingedly secured to the top end of the elongated strut 38 adjacent to handle 36, at axle 71. Lock plate 74 is secured to the outer surface of right wall 20, and leaf spring 76, which is fixed to strut 38, urges the pawl 70 to the left as is viewed in FIGS. 5 and 6. The pawl 70, lever 72, and the axle 71 are all contained within a recess 73 located within the top end of strut 38 adjacent to handle 36. As before, bising spring 54 urges the strut 38 away from right wall 20.

It can be seen in FIGS. 5 and 6 that when the legs are in their collapsed position, as can be seen in FIG. 5, that depression of pawl lever 72 will cause rotation of the pawl lever 72 in a counter-clockwise sense as seen in FIG. 5, against the pressure of leaf spring 76, and will bring the pawl 70 out of engagement with the lower end of lock plate 74. Thus, the strut 38 is free to move upwardly through gap 34 so that the legs can drop down under their own weight to erected position, and to rest eventually on top of lock plate 74 as is shown in FIG. 6, in which position the strut 38 is locked in its upper position, i.e. in that position in which the legs 72 are erected. As before, the mechanism shown in FIGS. 5 and 6 are duplicated, in mirror image, on the opposite side of container 10.

Figure 7:
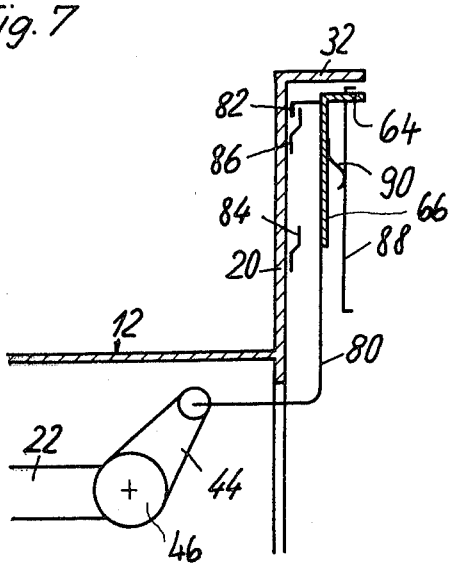
FIGS. 7 and 8 show the mechanism of a third embodiment of the invention, in, respectively, its collapsed and erected states.
Figure 8:
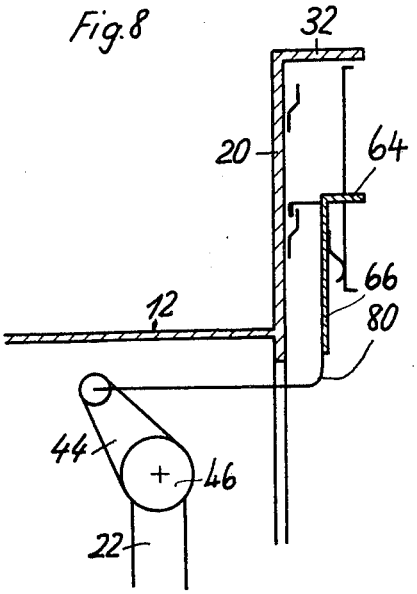

FIGS. 7 and 8 show a third embodiment of the invention, which utilizes a flexible element 80 such as a rope, to retract the legs after they have dropped to extended position under their own weight, this action being the same as in FIGS. 3–6. These diagrams are in schematic form. It can be seen in FIGS. 7 and 8 that in this third embodiment, there is no gap 34 at the right portion 32. Rather, strut 66 and handle 64 form an L-shaped element in which the handle 64 is generally parallel to the right portion 32 of the container 10. The handle 64 is perforated, and passes through a guide 88 which is fixed with respect to the container 10. Moreover, the uppermost end of element 80 is connected to the lowermost end of strut 66. It can be seen that handle 64 is thus operated by an operator not above right portion 32, but rather below it. A guide spring 90, which may be a leaf spring, is fixedly secured to strut 66 and abuts guide 88. Lower fixed hook 84 and upper fixed hook 86 are both secured to the outside of right wall 20, facing strut 66. A movable hook 82, fixed to the struts 66 and extending towards the fixed hooks, can be detachably engaged with either hook, depending upon the position in which the legs 22 are to be secured.

It can be seen from FIGS. 7 and 8 that the element 80 is directly secured to link 44. Thus, rotation of bar 46 can be accomplished in precisely the same fashion as was described in the previous two embodiments, by moving strut 66 upwardly and downwardly and thereby pulling the element 80, in turn causing link 44 to rotate and rotating bar 46 and legs 22. As before, the mechanism shown in FIGS. 7 and 8 is duplicated in mirror image on the opposite side of container 10.

Figure 9:
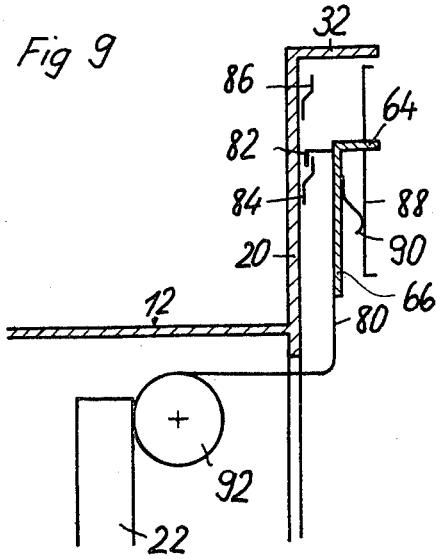
FIG. 9 shows the mechanism of a fourth embodiment of the invention.

FIG. 9 shows a fourth embodiment of the invention, which represents a minor change from the embodiment which is shown in FIGS. 7 and 8. Although the fourth embodiment utilizes a strut 66, a guide 88, hooks 82, 84, 86 and a handle 64 which move on element 88 in precisely the same fashion, the link 44 is replaced in this fourth embodiment with a reel 92. This reel may be located on bar 46 or may be connected directly to legs 22 as is shown in FIG. 9. In both this fourth embodiment and the third embodiment described above, the handle 64 is operated by lifting the handle 64 slightly towards right portion 32, shifting the handle 64 to the right as is shown in FIG. 7, 8, and 9 away from the hook 84 or 86 which is engaged, and then raising or lowering the handle 64 to engage the other hook 86 or 84.

It is desirable to provide a bearing 106 at each end of each bar 46 in order to prevent axial motion of the bars 46 with respect to the container 10.

It will be understood that each of the elements described above, or two or more together may also find a useful application in other types of constructions differing from the types described above.

While the invention has been illustrated and described as embodied in "A COLLAPSABLE BASKET WITH BEARING FOR USE THEREIN", it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that from the standpoint of prior art, fairly constitute essential characteristics of the generic of specific aspects of this invention.

What is claimed as new and desired to be protected by Letters Patent is set forth in the appended claims:

1. A collapsible basket, comprising a container having a top portion defining a peripheral flange with a horizontal base, a peripheral wall extending upwardly from around said base to said flange, and a peripheral skirt extending downwardly around the base to form an open-bottomed leg-storage region; a plurality of elongated legs connected in the container in the range of said leg-storage region for pivotal movement under the influence of their own weight and displacement in vertical direction; manually operable actuating means adjacent to the container and being coupled to the legs, said actuating means being operable between an erected position in which the legs extend downwardly from the base to support the container and a collapsed position in which the legs extend generally parallel to the base within the leg storage region, whereby the container can rest upon the skirt when the actuating means are in the collapsed position; locking means arranged on the container and on the actuating means to lock the actuating means in said collapsed position; and safety means arranged on said base and defining an upright recess for arresting said legs in their downwardly extended position when the actuating means are in the erected position and the container is set down, and for releasing the legs by relative axial movement of said legs away from the recess upon lifting said container.

2. A collapsible basket, comprising a container having a top portion defining a peripheral flange, a horizontal base, a peripheral wall extending upwardly from around said base to said flange, and a peripheral skirt extending downwardly around the base to form an open-bottomed leg-storage region; a plurality of elongated legs connected in the container in the range of said leg-storage region for pivotal movement and limited displacement in vertical direction; manually operable actuating means adjacent to the container and being coupled to the legs, said actuating means being operable between an erected position in which the legs extended downwardly from the base to support the container and a collapsed position in which the legs extend generally parallel to the base within the leg storage region, whereby the container can rest upon the skirt when the actuating means are in the collapsed position; locking means cooperating with the actuating means to lock the actuating means in the collapsed position; and safety means including recesses arranged on said base at the upper range of the vertical displacement of respective legs, and detent members arranged on said legs for engaging said recesses when the actuating means are in the erected position and said legs are in their downwardly extended position and the container is set down, or disengaging said recesses when the container is lifted up, the legs are displaced by their own weight to the lower range of their vertical displacement and the actuating means are free for being operated to their collapsed position.

3. A collapsible basket as defined in claim 2, wherein each of said legs is pivotally supported and guided for vertical displacement in an oblong slot provided in said skirt, and wherein said safety means includes a longer abutment secured to the base opposite one side of said oblong slot, a shorter abutment secured to the base opposite the longer abutment and defining therewith said recess, and a detent cam secured to each of said legs to rotate therewith past said shorter abutment and to engage said longer abutment when said actuating means are displaced into said erected position, and further to enter into the recess between and move into engagement with both of said abutments when said container is set down.

* * * * *